US008841897B2

(12) United States Patent
Williams et al.

(10) Patent No.: US 8,841,897 B2
(45) Date of Patent: Sep. 23, 2014

(54) VOLTAGE REGULATOR HAVING CURRENT AND VOLTAGE FOLDBACK BASED UPON LOAD IMPEDANCE

(75) Inventors: Matthew Williams, Binghamton, NY (US); Daniel Leonescu, Bucharest (RO); Scott Dearborn, Brackney, PA (US); Christian Albrecht, Echandens (CH)

(73) Assignee: Microchip Technology Incorporated, Chandler, AZ (US)

( * ) Notice: Subject to any disclaimer, the term of this patent is extended or adjusted under 35 U.S.C. 154(b) by 329 days.

(21) Appl. No.: 13/353,995

(22) Filed: Jan. 19, 2012

(65) Prior Publication Data

US 2012/0187930 A1 Jul. 26, 2012

Related U.S. Application Data

(60) Provisional application No. 61/435,911, filed on Jan. 25, 2011.

(51) Int. Cl.
*G05F 1/10* (2006.01)
*G05F 1/573* (2006.01)

(52) U.S. Cl.
CPC ..... *G05F 1/5735* (2013.01)
USPC ..... 323/285

(58) Field of Classification Search
CPC ..... G05F 1/573; G05F 1/613
USPC ..... 323/273, 276, 280, 281, 285, 901
See application file for complete search history.

(56) References Cited

U.S. PATENT DOCUMENTS

| | | | | |
|---|---|---|---|---|
| 3,617,859 | A * | 11/1971 | Dobkin et al. | 323/313 |
| 5,192,905 | A * | 3/1993 | Karlin et al. | 320/145 |
| 5,666,044 | A * | 9/1997 | Tuozzolo | 323/277 |
| 6,201,375 | B1 | 3/2001 | Larson et al. | 323/277 |
| 7,504,814 | B2 * | 3/2009 | Lee et al. | 323/316 |
| 7,834,600 | B2 * | 11/2010 | Bassett et al. | 323/265 |
| 7,852,054 | B2 * | 12/2010 | Kao et al. | 323/277 |
| 2005/0083027 | A1 | 4/2005 | Kikuchi | 323/287 |
| 2009/0046404 | A1 | 2/2009 | Morino | 361/93.9 |
| 2010/0090664 | A1 | 4/2010 | Jian | 323/277 |

OTHER PUBLICATIONS

International Search Report and Written Opinion, Application No. PCT/US2012/021971, 7 pages, Mar. 1, 2013.

* cited by examiner

*Primary Examiner* — Adolf Berhane
*Assistant Examiner* — Yemane Mehari
(74) *Attorney, Agent, or Firm* — King & Spalding L.L.P.

(57) ABSTRACT

The regulated output voltage of a voltage regulator is maintained up to a current limit, $I_{limit}$, then as the load impedance continues to decrease the output current does not increase past the current limit, $I_{limit}$, but rather the output voltage decreases forcing the output current to also decrease to satisfy Ohm's Law: $I_{OUT}=V_{OUT}/Z_{Load}$. When the output voltage drops below the regulated voltage value because of current limiting the voltage regulator shifts from a current limit mode to a current foldback mode wherein the output current decreases with the decrease in output voltage until the output current reaches a current foldback minimum, $I_{foldback}$, at an output voltage of substantially zero volts. As the load impedance increases so will the output voltage and current until the output voltage is back at substantially the regulation voltage value, and the output current is less than or equal to the current limit, $I_{limit}$.

15 Claims, 4 Drawing Sheets

VOLTAGE REGULATOR HAVING CURRENT AND VOLTAGE FOLDBACK BASED UPON LOAD IMPEDANCE

RELATED PATENT APPLICATION

This application claims priority to commonly owned U.S. Provisional Patent Application Ser. No. 61/435,911; filed Jan. 25, 2011; entitled "Voltage Regulator Current Foldback Based Upon Load Impedance," by Matthew Williams, Daniel Leonescu, Scott Dearborn and Christian Albrecht; which is hereby incorporated by reference herein for all purposes.

TECHNICAL FIELD

The present disclosure relates to voltage regulators, and, more particularly, to a voltage regulator having current foldback based upon load impedance.

BACKGROUND

Folding back current and voltage during overload or short circuit conditions reduces power consumption and thermal stresses. Current and voltage foldback also increases safety from thermal overload. Current and voltage foldback makes a device inherently safer from a thermal and electrical viewpoint. Current and voltage foldback allows a device to handle indefinite short circuit conditions without degrading performance, and prevents excess current draw from a power source, e.g., battery.

SUMMARY

Therefore a need exists in a voltage regulator for a current and voltage foldback feature that allows the voltage regulator to handle indefinite short circuit conditions without degrading performance, and prevents excess current draw from a power source, e.g., battery.

According to an embodiment, a voltage regulator having current and voltage foldback based upon load impedance may comprise: a power transistor having a gate, a source and a drain, wherein the power transistor is coupled between a power source and a load; a voltage divider coupled in parallel with the load and providing a feedback voltage that represents an output voltage from the power transistor to the load; an error amplifier having a first input coupled to a reference voltage, a second input coupled to the feedback voltage, and an output coupled to the gate of and controlling the power transistor, wherein the error amplifier causes the power transistor to maintain the feedback voltage at substantially the same voltage as the reference voltage; a current sensing circuit for measuring current to the load and providing a sense current representative of the measured load current; a current limit and foldback circuit having a first input coupled to the feedback voltage, a second input coupled to the reference voltage, a third input coupled to the sense current from the current sensing circuit, and an output providing a current foldback bias; and a current-to-voltage offset bias source having a current input and a voltage output, the current input thereof is coupled to the output of the current limiting and foldback circuit providing the current foldback bias, and the voltage output thereof is coupled between the first and second inputs of the error amplifier and provides a voltage offset bias proportional to the current foldback bias from the current limiting and foldback circuit; wherein the current limit and foldback circuit is in a current limit mode when the load current is less than or equal to a current limit value, and in a foldback mode when an output load impedance is less than a foldback load impedance value; whereby the voltage offset bias is substantially zero volts when the load current is less than the current limit value and the output load impedance is greater than the foldback load impedance value, and increases when the output load impedance is less than or equal to the foldback load impedance value, thereby reducing the output voltage and the output current proportionally until the output voltage is at substantially zero volts and the output current is at a foldback current value.

According to a further embodiment, the reference voltage is provided by a bandgap voltage reference. According to a further embodiment, the reference voltage is provided by a zener diode voltage reference. According to a further embodiment, the voltage regulator is a low drop out (LDO) voltage regulator. According to a further embodiment, the power transistor is a power metal oxide semiconductor field effect transistor (MOSFET). According to a further embodiment, the power MOSFET is a P-channel MOSFET.

According to a further embodiment, the current sensing circuit comprises: a first transistor having a gate, a source and a drain, the sources of the first transistor and the power transistor are connected together, the gates of the first transistor and the power transistor are connected together, the first transistor has a width (W) substantially smaller than the power transistor, wherein the first transistor senses the load current through the power transistor; a second transistor having a gate, a source and a drain; and an operational amplifier having a positive input, a negative input and an output, the output of the operational amplifier is coupled to the gate of the second transistor, the positive input is coupled to the drains of the first and second transistors, and the negative input is coupled to the drain of the power transistor and the load; wherein the sense current is provided from the source of the second transistor. According to a further embodiment, the width (W) of the first transistor less than or equal to about one thousandth (1/1000) the width of the power transistor.

According to a further embodiment, operation of the current limit and foldback circuit may comprise the steps of: converting the sense current into a sense voltage; comparing the feedback voltage to the sense voltage, wherein if the sense voltage is less than the feedback voltage then the current foldback bias is at substantially a zero current value, and if the sense voltage is greater than the feedback voltage then the current foldback bias increases above the zero current value, wherein the current-to-voltage offset bias source induces an offset voltage at the first and second inputs of the error amplifier, whereby the output of the error amplifier is limited so that the load current will exceed the current limit value; comparing the feedback voltage to the reference voltage, wherein if the feedback voltage is substantially the same as the reference voltage then remain in the current limit mode, and if the feedback voltage is less than the reference voltage then go into the current foldback mode, whereby the output current decreases proportionally with a decrease in the output load impedance.

According to a further embodiment, a hysteresis/offset comparator is added to force the current limit and foldback circuit to go from the current limit mode to the current foldback mode when the load current is at substantially the current limit value. According to a further embodiment, an analog voltage multiplexer is added for substituting the reference voltage for the feedback voltage during a power-on start-up condition for charging a filter capacitor at the current limit value. According to a further embodiment, the foldback current value is less than or equal to about ten (10) milliamperes.

According to another embodiment, a method for folding back output current in a voltage regulator based upon load impedance, may comprise the steps of: controlling a voltage drop between a power source and a load with a power transistor; dividing a voltage at the load with a voltage divider to provide a feedback voltage representative of the voltage at the load; comparing the feedback voltage to a reference voltage; controlling the power transistor so that feedback voltage is at substantially the same voltage as the reference voltage; measuring current to the load and providing a sense current representative of the measured load current; generating a voltage offset bias from the sense current, the feedback voltage and the reference voltage, wherein if the load current is less than a current limit value then remaining in a current limit mode, and if an output load impedance is less than a foldback load impedance value then going into a foldback mode and begin increasing the voltage offset bias; whereby the voltage offset bias is substantially zero volts when the load current is less than the current limit value and the output load impedance is greater than the foldback load impedance value, and increases when the output load impedance is less than or equal to the foldback load impedance value, thereby reducing the output voltage and the output current proportionally until the output voltage is at substantially zero volts and the output current is at a foldback current value.

According to a further embodiment of the method, a step of substituting the reference voltage for the feedback voltage during power-on start-up of the voltage regulator is added. According to a further embodiment of the method, a step of providing hysteresis between the current limit mode and the current foldback mode is added.

BRIEF DESCRIPTION OF THE DRAWINGS

A more complete understanding of the present disclosure may be acquired by referring to the following description taken in conjunction with the accompanying drawings wherein.

Figure 1:
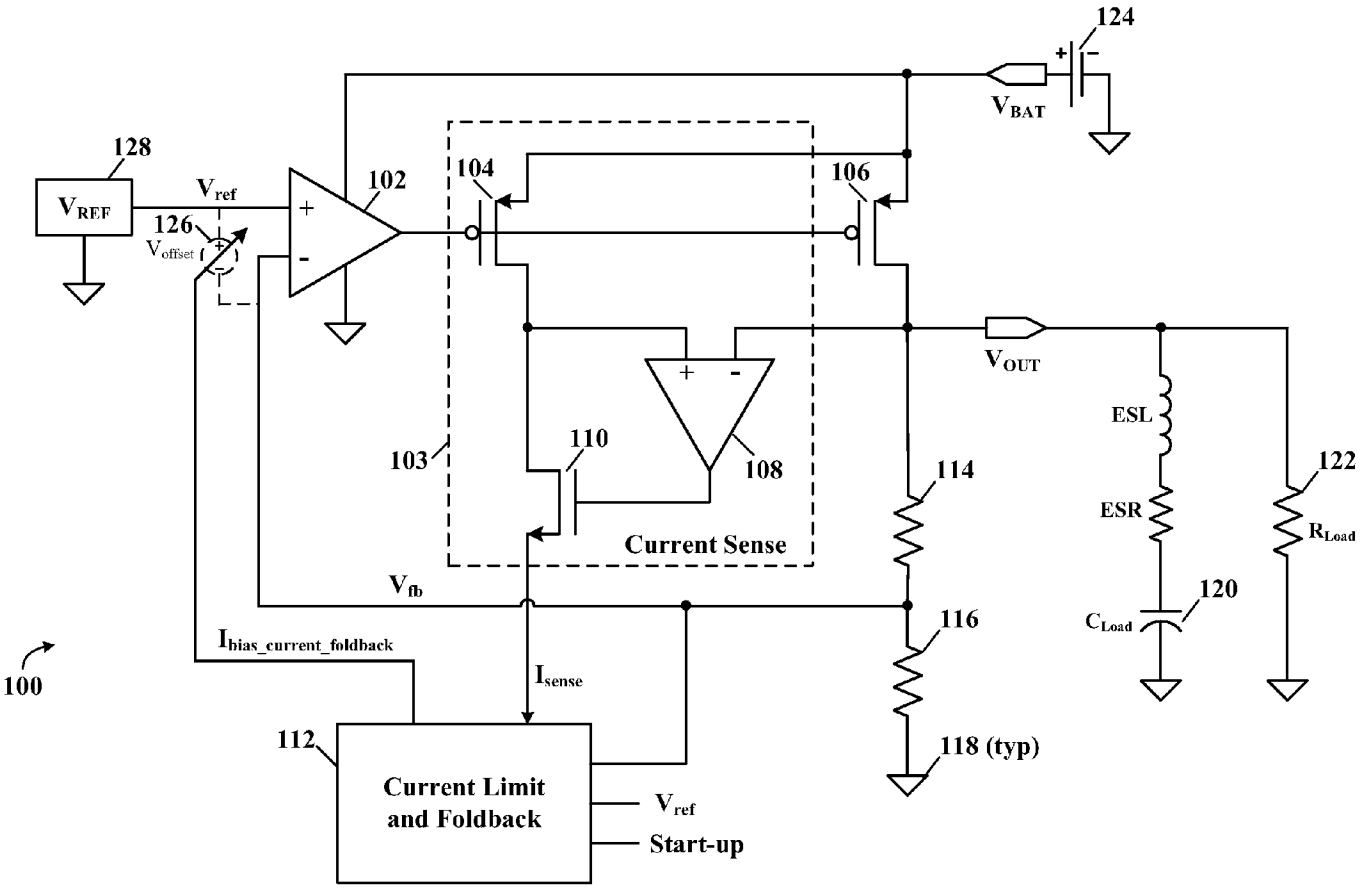
FIG. 1 illustrates a schematic circuit and block diagram of a voltage regulator having current and voltage foldback based upon load impedance, according to a specific example embodiment of this disclosure.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

The output current and voltage of a voltage regulator will foldback towards zero (0) amperes and volts, respectively, as the load impedance is decreased beyond the maximum load handling capacity of the voltage regulator, according to the teachings of this disclosure. The voltage regulator current will foldback towards, for example but not limited to, about ten (10) milliamperes or less and about zero (0) volts under short circuit conditions. When the output overload is removed, the voltage regulator output current and voltage will recover and continue operating. Limiting power consumption during output overload conditions enhances electrical performance of the device associated with the regulator.

The regulated output voltage is maintained up to a current limit, $I_{limit}$, (current limit mode) then if the load impedance, $Z_{Load}$, continues to decrease the output voltage will decrease proportionally to the decrease in the load impedance, $Z_{Load}$, thereby causing a decrease in output current to satisfy Ohm's Law: $I=V_{OUT}/Z_{Load}$. When the output voltage starts dropping below the regulated voltage value because of the decrease in the load impedance, $Z_{Load}$, the voltage regulator shifts from the current limit mode to a foldback mode wherein the output voltage decreases, and thus output current decreases, with decreasing $Z_{Load}$ until the output current reaches a foldback minimum, $I_{foldback}$, at an output voltage of substantially zero volts. Thus, both current and voltage foldback values are dependent upon the value of the load impedance, $Z_{Load}$. As the load impedance, $Z_{Load}$, begins to increase so will the output current and voltage until the output voltage is back at substantially the regulation voltage value, and the output current is less than or equal to the current limit, $I_{limit}$. The voltage regulator may also be configured as a low drop out (LDO) voltage regulator.

Referring now to the drawings, the details of a specific example embodiment is schematically illustrated. Like elements in the drawings will be represented by like numbers, and similar elements will be represented by like numbers with a different lower case letter suffix.

Referring to FIG. 1, depicted is a schematic circuit and block diagram of a voltage regulator having current and voltage foldback based upon load impedance, according to a specific example embodiment of this disclosure. A voltage regulator having current and voltage foldback based upon load impedance, generally represented by the numeral 100, comprises an error amplifier 102, a current sense circuit 103, a power pass transistor 106, a current limit and foldback circuit 112, voltage divider resistors 114 and 116, a voltage offset bias source 126, and a voltage reference 128. The power pass transistor 106 may be, for example but is not limited to, a P-channel metal oxide semiconductor field effect transistor (P-MOS FET), etc. The voltage regulator 100 may be a low drop out (LDO) voltage regulator.

The voltage regulator 100 receives power from a power source 124, e.g., a battery (shown), and supplies a regulated voltage, $V_{OUT}$, to a capacitor 120 and a load resistance 122 representing power utilization circuits or devices (not shown). The capacitor 120 also comprises an equivalent series inductance (ESL) and an equivalent series resistance (ESR). The voltage reference 128 may be, for example but is not limited to, a bandgap voltage reference, a zener diode reference, etc. The voltage divider resistors 114 and 116 form a resistive voltage divider network connected to the regulated voltage, $V_{OUT}$, and at the junction between the resistors 114 and 116 a feedback voltage, $V_{fb}$, is provided for use in the voltage regulation process. Wherein:

$$V_{fb}=V_{OUT}*R116/(R114+R116) \quad \text{equation (1)}$$

The error amplifier 102 may comprise an operational amplifier, having differential inputs (+, −), which compares the feedback voltage, $V_{fb}$, with a reference voltage, $V_{ref}$, supplied from the voltage reference 128, and drives the gate of the power pass transistor 106 so that equation (1) is satisfied (maintained). In normal operation of the voltage regulator 100 when in the regulation mode, the feedback voltage, $V_{fb}$, input (−) and the reference voltage, $V_{ref}$, input (+) are substantially the same voltages (dependant upon the voltage gain of the error amplifier 102). Thus the relationship between $V_{OUT}$ and $V_{ref}$ is:

$$V_{OUT}=V_{ref}*(R114+R116)/R116 \quad \text{equation (2)}$$

The current sense circuit 103 comprises a current sense transistor 104, a transistor 110 and an operational amplifier 108. The current sense circuit 103 measures the output current into the load resistance 122. The current sense transistor 104 is the same type as the power pass transistor 106. However, the W ratio between the power pass transistor 106 and the current sense transistor 104 is very large (typically greater than 1000) in order to reduce current flowing into the circuit common 118, e.g., ground current. The operational amplifier 108 is used to insure that the power pass transistor 106 and the current sense transistor 104 maintain substantially the same drain-source voltage, Vds, thereby insuring accurate current sensing in all modes of operation of the voltage regulator 100. The sense current, $I_{sense}$, flowing out of the current sense circuit 103 represents a small fraction of the current flowing through the power pass transistor 106. Since the current through the voltage divider resistors 114 and 116 is extremely small, the sense current, $I_{sense}$, may be considered proportional to the load current (current into the load is represented by the load resistance 122). The current sense transistor 104 may be, for example but is not limited to, a P-channel metal oxide semiconductor field effect transistor (P-MOS FET), and transistor 110 may be, for example but is not limited to, an N-channel metal oxide semiconductor field effect transistor (N-MOS FET).

The current limit and foldback circuit 112 continuously monitors both the output current using the sense current, $I_{sense}$, and output voltage using the feedback voltage, $V_{fb}$. In the normal mode of operation of the voltage regulator 100 the bias current, $I_{bias_current_foldback}$, from the current limit and foldback circuit 112 substantially is zero and an offset voltage, $V_{offset}$, generated by the voltage offset bias source 126 is disabled (e.g., no effect on the operation of the error amplifier 102). If an overload condition is detected, then the bias current, $I_{bias_current_foldback}$, increases and causes the voltage offset bias source 126 to generate an offset voltage, $V_{offset}$, to increase at the inputs of the error amplifier 102. Consequently, the error amplifier 102 output voltage swing is limited at its lower end and the error amplifier 102 cannot overdrive the power pass transistor 106 (the gate-to-source voltage of the power pass transistor 106 is not allowed to increase). A more detailed description of the implementation of the voltage offset bias source 126 and the error amplifier 102 is shown in FIG. 2 and provided in the description thereto.

Figure 2:
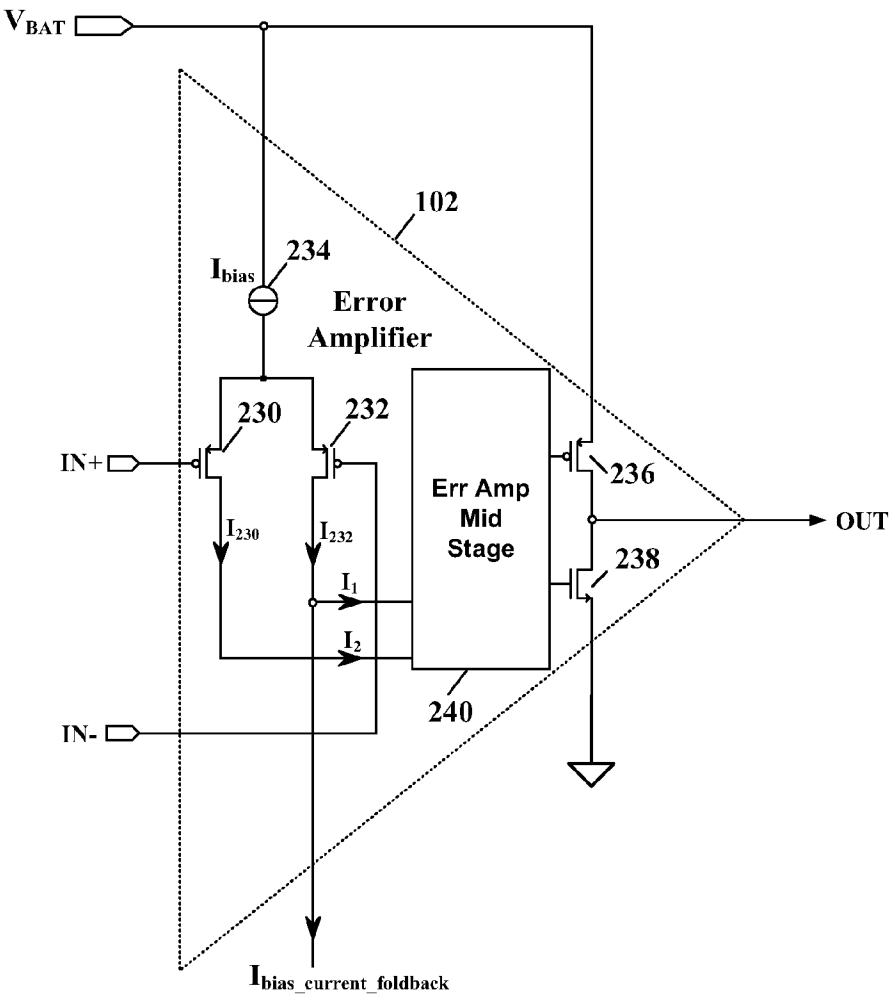
FIG. 2 illustrates a schematic circuit diagram of the error amplifier shown in FIG. 1.

Referring to FIG. 2, depicted is a schematic circuit diagram of the error amplifier shown in FIG. 1. The error amplifier 102 comprises three stages: 1) an input stage comprising differential pair transistors 230 and 232, 2) a middle stage 240, and 3) a push-pull output stage comprising transistors 236 and 238. The input differential pair transistors 230 and 232 are biased from a current source 234, $I_{bias}$. If the output current of the regulator is smaller than the limit current, $I_{limit}$, the $I_{bias_current_foldback}$ is substantially zero, thus $I_1$ and $I_2$ are equal ($I_1=I_{232}=I_{bias}/2$; $I_2=I_{230}=I_{bias}/2$) and therefore no extra offset develops at the input of the error amplifier 102. However, if $I_{bias_current_foldback}$ becomes higher than zero (in the case of an overload event at the regulator's output), it forces a difference between the currents through transistors 230 and 232, and consequently a voltage offset is thereby induced to the input stage of the error amplifier 102 by the voltage offset bias source 126, $V_{offset}$. This voltage offset forces a reduction in the output voltage of the regulator. Thus resulting in a lower current and hence "foldback." It is contemplated and within the scope of this disclosure that other circuit designs may be implemented by one skilled in analog integrated circuit design and having the benefit of this disclosure.

Figure 3:
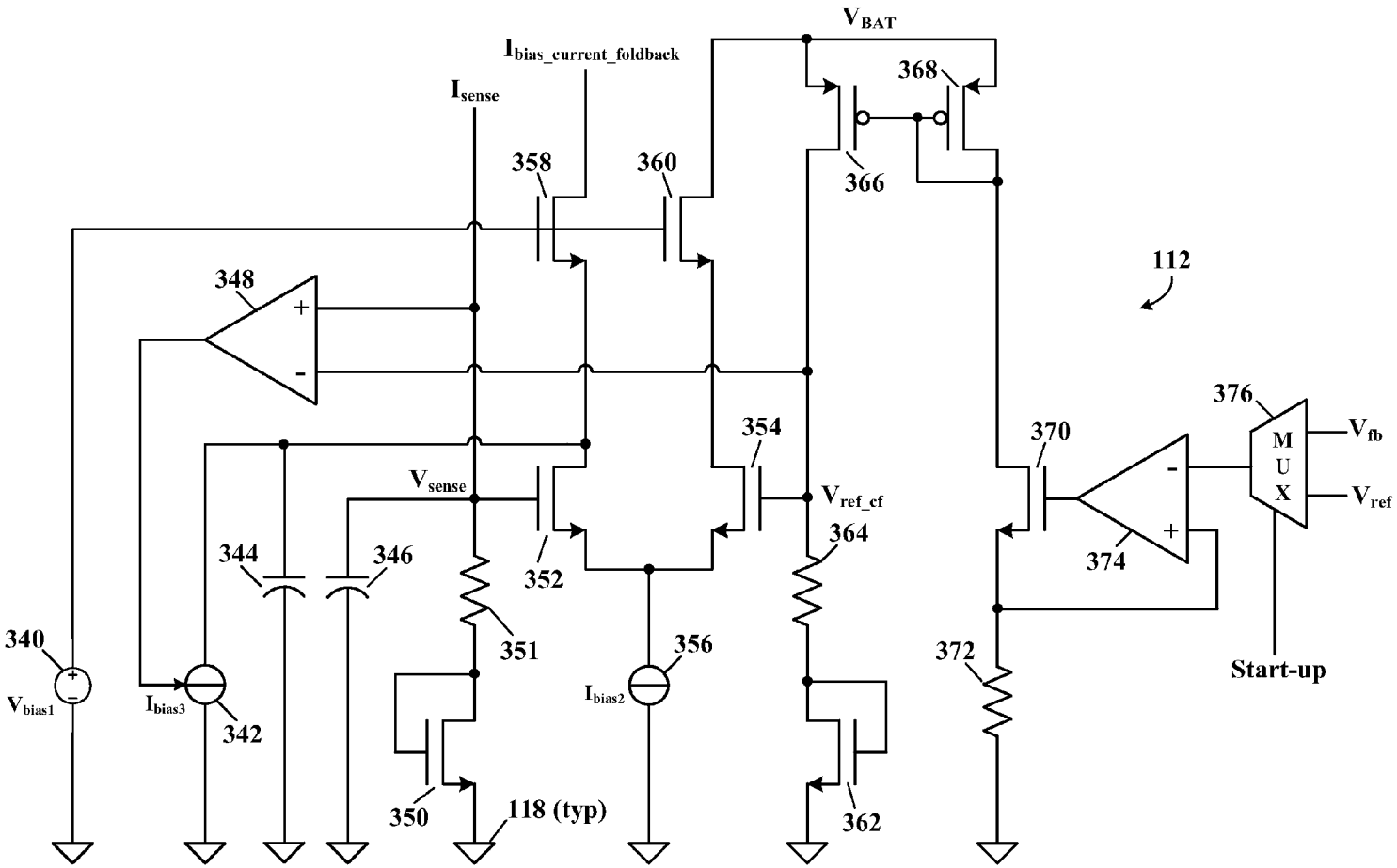
FIG. 3 illustrates a schematic circuit diagram of the current and voltage foldback circuit shown in FIG. 1.

Referring to FIG. 3, depicted is a schematic circuit diagram of the current and voltage foldback circuit shown in FIG. 1. The current limit and foldback circuit 112 comprises a hysteresis/offset comparator 348, transistors 352, 354, 358, 360, 362, 366, 368 and 370; an operational amplifier 374, a multiplexer 376, and resistors 351, 364 and 372. The sense current, $I_{sense}$, flows through resistor 351 and diode-connected transistor 350, resulting in a voltage, $V_{sense}$, at the base of transistor 352 that is proportional to output current as follows:

$$V_{sense}=R351*I_{sense}+Vgs \text{ of transistor } 350 \quad \text{equation (3)}$$

When the feedback voltage, $V_{fb}$, is coupled through the multiplexer 376 to the operational amplifier 374 and transistor 370, a current is generated that is proportional to the feedback voltage, $V_{fb}$. Transistor 370 and operational amplifier 374 comprise a linear voltage-to-current converter, wherein the current through resistor 372 is equal to $V_{fb}$/R372. This current flows through transistor 370 and is mirrored by transistors 366 and 368, which form a current mirror. Therefore, the voltage, $V_{ref_cf}$, at the base of transistor 354 is linearly dependent on the feedback voltage, $V_{fb}$, as follows:

$$V_{ref_cf}=(R364/R372)*V_{fb}+Vgs \text{ of transistor } 362 \quad \text{equation (4)}$$

Transistors 352 and 354 are configured as a differential pair and are used to compare $V_{ref_cf}$ with $V_{sense}$. If $V_{sense}$ is at a lower voltage than $V_{ref_cf}$ then the current delivered by the current source 356 ($I_{bias2}$) flows through transistors 354 and 360, and the $I_{bias_current_foldback}$ current is substantially zero. This is normal operation of the voltage regulator 100.

If the output current gets very large (because of a decrease in value of the load resistance 122), $V_{sense}$ becomes larger than $V_{ref_cf}$ and as a result a foldback bias current, $I_{bias_current_foldback}<-I_{bias2}$, is allowed to flow towards the voltage offset bias source 126 which induces an offset voltage, $V_{offset}$, at the differential inputs of the error amplifier 102. Consequently, the output of the error amplifier 102 is limited at its lower end and the output current cannot further increase ($I_{out\ max}=I_{limit}$). This is the "current limit" mode.

As the value of the load resistance 122 decreases further, Vout is pulled lower, and $V_{fb}$ decreases as well (equation 2) and $V_{ref_cf}$ decreases (equation 4), which increases the $I_{bias_current_foldback}$ current (voltage offset bias source 126, $V_{offset}$, increases at the inputs to the error amplifier 102), resulting in a further limitation of the output swing of the error amplifier 102. This is the "foldback" mode. Eventually, the output voltage reaches zero and the corresponding output current becomes the foldback current, $I_{foldback}$. For high performance voltage regulator circuits the foldback current, $I_{foldback}$, is very low, e.g., 10 milliamperes or less.

The output of the multiplexer 376 is coupled to an input of the operational amplifier 374 and is used to disable the foldback function during Start-up when $V_{out}$ is low and $I_{out}$ is large, e.g., charging the output filter capacitor 120. As a result, the maximum current available to charge the output filter capacitor 120 is the limit current, $I_{limit}$. Transistors 350 and 362 are diode connected and are used to prevent transistors 352 and 354 (differential pair), respectively, from both going in a cutoff region. Transistors 358 and 360 act as cascode transistors for transistors 352 and 354, respectively. The $V_{sense}$ voltage is derived from the resistor 351, consequently, the $V_{sense}$ voltage depends on the process stability of resistor 351. Therefore resistor 351, preferably, should have a temperature coefficient that will compensate for the Vgs decrease with temperature of transistor 350. Capacitors 344 and 346 may be used to assure the stability of the current limit loop and to make it less sensitive to noise.

The hysteresis/offset comparator 348 may be used to eliminate a potential unstable state that may occur if the load resistance 122 is at such a value wherein the regulation loop and foldback loop "cancel" each other. The controlled current source 342, $I_{bias3}$, substantially equals $I_{bias_current_foldback}$ the moment output current approaches the limit current, thus forcing the voltage regulator 100 to go into the foldback current protective mode.

Transistors 366 and 368 may be, for example but are not limited to, P-channel metal oxide semiconductor field effect transistors (P-MOS FETs), and transistors 352, 354, 358, 360, 362 and 370 may be, for example but is not limited to, N-channel metal oxide semiconductor field effect transistors (N-MOS FETs).

Figure 4:
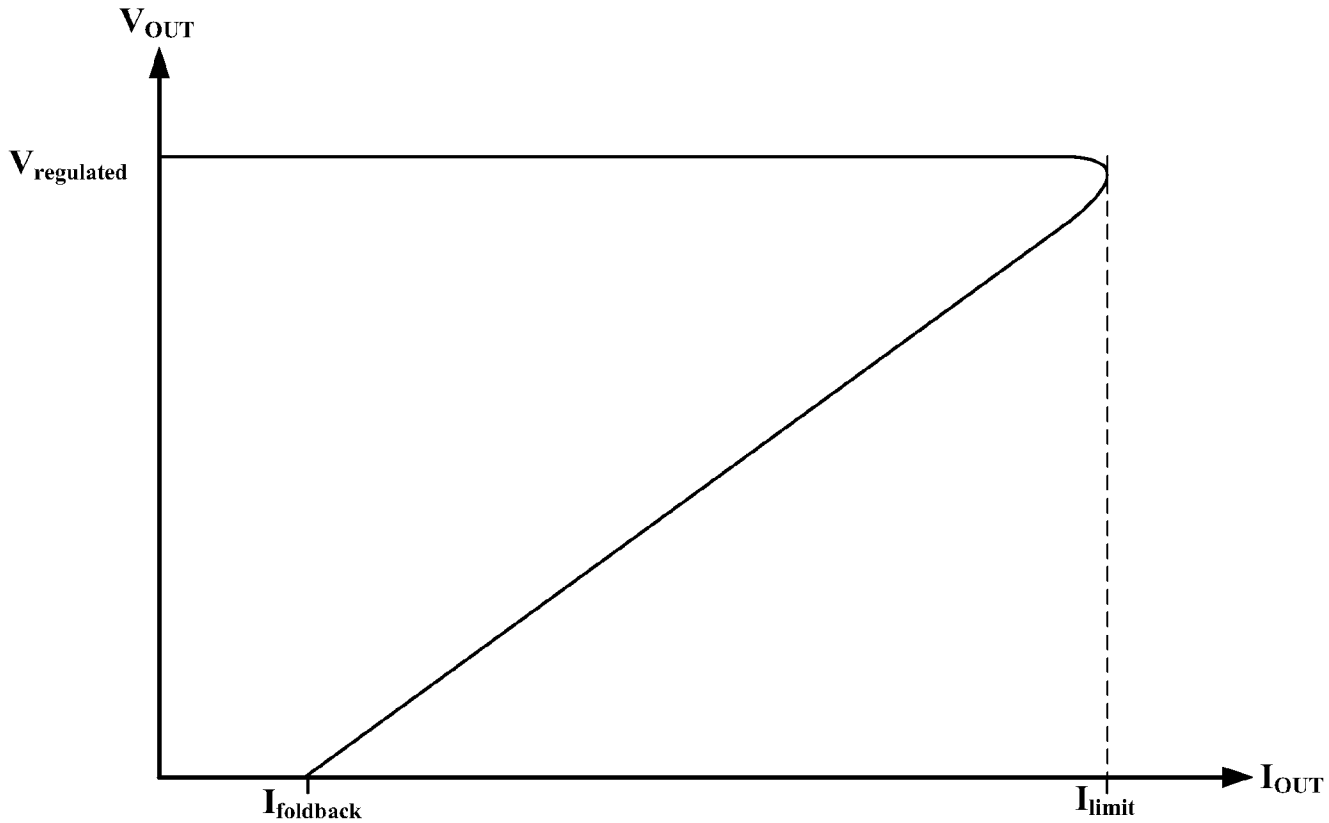
FIG. 4 illustrates a graphical representation of the current and voltage foldback function based upon load impedance, according to the teachings of this disclosure.

Referring to FIG. 4, depicted is a graphical representation of the current and voltage foldback function based upon load impedance, according to the teachings of this disclosure. $V_{OUT}$ stays at the regulated voltage determined by reference voltage, $V_{ref}$, until the current limit, $I_{limit}$, is reached, then any further decease in the load impedance 122, $Z_{Load}$, will cause $V_{OUT}$ to decrease when in the current limit mode. As the load impedance 122, $Z_{Load}$, decreases further the foldback mode takes over from the current limit mode so that as the load impedance 122, $Z_{Load}$, further decreases so does the foldback voltage, $V_{OUT}$, thus resulting in a lower load current, i.e., I=V/R (Ohm's Law).

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A voltage regulator having current and voltage foldback based upon load impedance, comprising:

a power transistor having a gate, a source and a drain, wherein the power transistor is coupled between a power source and a load;

a voltage divider coupled in parallel with the load and providing a feedback voltage that represents an output voltage from the power transistor to the load;

an error amplifier having a first input coupled to a reference voltage, a second input coupled to the feedback voltage, and an output coupled to the gate of and controlling the power transistor, wherein the error amplifier causes the power transistor to maintain the feedback voltage at substantially the same voltage as the reference voltage;

a current sensing circuit for measuring current to the load and providing a sense current representative of the measured load current;

a current limit and foldback circuit having a first input coupled to the feedback voltage, a second input coupled to the reference voltage, a third input coupled to the sense current from the current sensing circuit, and an output providing a current foldback bias; and a current-to-voltage offset bias source having a current input and a voltage output, the current input thereof is coupled to the output of the current limiting and foldback circuit providing the current foldback bias, and the voltage output thereof is coupled between the first and second inputs of the error amplifier and provides a voltage offset bias proportional to the current foldback bias from the current limiting and foldback circuit;

wherein the current limit and foldback circuit is in a current limit mode when the load current is less than or equal to a current limit value, and in a foldback mode when an output load impedance is less than a foldback load impedance value;

whereby the voltage offset bias is substantially zero volts when the load current is less than the current limit value and the output load impedance is greater than the foldback load impedance value, and increases when the output load impedance is less than or equal to the foldback load impedance value, thereby reducing the output voltage and the output current proportionally until the output voltage is at substantially zero volts and the output current is at a foldback current value.

2. The voltage regulator according to claim 1, wherein the reference voltage is provided by a bandgap voltage reference.

3. The voltage regulator according to claim 1, wherein the reference voltage is provided by a zener diode voltage reference.

4. The voltage regulator according to claim 1, wherein the voltage regulator is a low drop out (LDO) voltage regulator.

5. The voltage regulator according to claim 1, wherein the power transistor is a power metal oxide semiconductor field effect transistor (MOSFET).

6. The voltage regulator according to claim 5, wherein the power MOSFET is a P-channel MOSFET.

7. The voltage regulator according to claim 1, wherein the current sensing circuit comprises:

a first transistor having a gate, a source and a drain, the sources of the first transistor and the power transistor are connected together, the gates of the first transistor and the power transistor are connected together, the first transistor has a width (W) substantially smaller than the power transistor, wherein the first transistor senses the load current through the power transistor, a second transistor having a gate, a source and a drain; and an operational amplifier having a positive input, a negative input and an output, the output of the operational amplifier is coupled to the gate of the second transistor, the positive input is coupled to the drains of the first and second transistors, and the negative input is coupled to the drain of the power transistor and the load;

wherein the sense current is provided from the source of the second transistor.

8. The voltage regulator according to claim 7, wherein the width (W) of the first transistor less than or equal to about one thousandth (1/1000) the width of the power transistor.

9. The voltage regulator according to claim 1, wherein operation of the current limit and foldback circuit comprises the steps of:

converting the sense current into a sense voltage;

comparing the feedback voltage to the sense voltage, wherein if the sense voltage is less than the feedback voltage then the current foldback bias is at substantially a zero current value, and if the sense voltage is greater than the feedback voltage then the current foldback bias increases above the zero current value, wherein the current-to-voltage offset bias source induces an offset voltage at the first and second inputs of the error amplifier, whereby the output of the error amplifier is limited so that the load current will exceed the current limit value;

comparing the feedback voltage to the reference voltage, wherein if the feedback voltage is substantially the same as the reference voltage then remain in the current limit mode, and if the feedback voltage is less than the reference voltage then go into the current foldback mode, whereby the output current decreases proportionally with a decrease in the output load impedance.

10. The voltage regulator according to claim 9, further comprising a hysteresis/offset comparator, wherein the hysteresis/offset comparator forces the current limit and foldback circuit to go from the current limit mode to the current foldback mode when the load current is at substantially the current limit value.

11. The voltage regulator according to claim 9, further comprising an analog voltage multiplexer for substituting the reference voltage for the feedback voltage during a power-on start-up condition for charging a filter capacitor at the current limit value.

12. The voltage regulator according to claim 1, wherein the foldback current value is less than or equal to about ten (10) milliamperes.

13. A method for folding back output current in a voltage regulator based upon load impedance, comprising the steps of:

controlling a voltage drop between a power source and a load with a power transistor;

dividing a voltage at the load with a voltage divider to provide a feedback voltage representative of the voltage at the load;

comparing the feedback voltage to a reference voltage;

controlling the power transistor so that feedback voltage is at substantially the same voltage as the reference voltage;

measuring current to the load and providing a sense current representative of the measured load current;

generating a voltage offset bias from the sense current, the feedback voltage and the reference voltage, wherein if the load current is less than a current limit value then remaining in a current limit mode, and if an output load impedance is less than a foldback load impedance value then going into a foldback mode and begin increasing the voltage offset bias;

whereby the voltage offset bias is substantially zero volts when the load current is less than the current limit value and the output load impedance is greater than the foldback load impedance value, and increases when the output load impedance is less than or equal to the foldback load impedance value, thereby reducing the output voltage and the output current proportionally until the output voltage is at substantially zero volts and the output current is at a foldback current value.

14. The method according to claim 13, further comprising the step of substituting the reference voltage for the feedback voltage during power-on start-up of the voltage regulator.

15. The method according to claim 13, further comprising the step of providing hysteresis between the current limit mode and the current foldback mode.

* * * * *